US012808009B2

(12) United States Patent
Hong

(10) Patent No.: US 12,808,009 B2
(45) Date of Patent: Nov. 24, 2026

(54) PRESSURE VESSEL STEEL PLATE HAVING EXCELLENT HIGH TEMPERATURE PWHT RESISTANCE AND METHOD FOR MANUFACTURING SAME

(71) Applicant: POSCO CO., LTD, Pohang-si (KR)

(72) Inventor: Soon-Taik Hong, Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 535 days.

(21) Appl. No.: 18/038,604

(22) PCT Filed: Nov. 15, 2021

(86) PCT No.: PCT/KR2021/016649
§ 371 (c)(1),
(2) Date: May 24, 2023

(87) PCT Pub. No.: WO2022/131570
PCT Pub. Date: Jun. 23, 2022

(65) Prior Publication Data

US 2024/0093326 A1 Mar. 21, 2024

(30) Foreign Application Priority Data

Dec. 16, 2020 (KR) ..... 10-2020-0176051

(51) Int. Cl.

| | |
|---|---|
| ***C22C 38/00*** | (2006.01) |
| ***C21D 1/18*** | (2006.01) |
| ***C21D 1/84*** | (2006.01) |
| ***C21D 6/00*** | (2006.01) |
| ***C21D 8/02*** | (2026.01) |
| ***C21D 8/0221*** | (2026.01) |
| ***C21D 8/0247*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |

(52) U.S. Cl.
CPC ..... *C21D 9/46* (2013.01); *C21D 1/18* (2013.01); *C21D 1/84* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C21D 2211/002* (2013.01); *C21D 2211/008* (2013.01)

(58) Field of Classification Search
CPC ... C21D 9/46; C21D 1/18; C21D 1/84; C21D 6/002; C21D 6/005; C21D 6/008; C21D 8/0205; C21D 8/0226; C21D 8/0263; C21D 2211/002; C21D 2211/008; C21D 8/0273; C21D 1/26; C21D 8/0247; C22C 38/002; C22C 38/02; C22C 38/04; C22C 38/06; C22C 38/22; C22C 38/24; C22C 38/26
See application file for complete search history.

(56) References Cited

U.S. PATENT DOCUMENTS

| | | | | |
|---|---|---|---|---|
| 4,504,554 | A * | 3/1985 | Yoshioka | F01D 5/06 428/683 |
| 2005/0257853 | A1* | 11/2005 | Yamashita | B23K 26/34 148/26 |
| 2015/0083278 | A1 | 3/2015 | Kawata et al. | |
| 2018/0202019 | A1 | 7/2018 | Toda et al. | |
| 2018/0371567 | A1 | 12/2018 | Hong | |
| 2018/0371568 | A1 | 12/2018 | Hong | |
| 2020/0071798 | A1 | 3/2020 | Hong | |
| 2020/0087762 | A1 | 3/2020 | Ahn et al. | |
| 2022/0025495 | A1 | 1/2022 | Hong | |
| 2022/0033926 | A1 | 2/2022 | Im et al. | |
| 2024/0102137 | A1 | 3/2024 | Hong | |

FOREIGN PATENT DOCUMENTS

| | | | |
|---|---|---|---|
| CN | 109930065 | A | 6/2019 |
| EP | 3255166 | A1 | 12/2017 |
| EP | 2 918 694 | B1 | 1/2018 |
| EP | 3 372 702 | B1 | 7/2022 |
| JP | 59-80755 | A | 5/1984 |
| JP | 01-319629 | A | 12/1989 |
| JP | H01319629 | A * | 12/1989 |
| JP | 08-85848 | A | 4/1996 |
| JP | 2528387 | B2 | 8/1996 |

(Continued)

OTHER PUBLICATIONS

JP-2020020031-A, machine translation. (Year: 2020).*

(Continued)

*Primary Examiner* — John A Hevey
(74) *Attorney, Agent, or Firm* — Sughrue Mion, PLLC

(57) ABSTRACT

The present invention relates to a pressure vessel steel plate having excellent high temperature PWHT resistance, comprising: 0.10-0.16 weight % C; 0.20-0.35 weight % Si; 0.4-0.6 weight % Mn; 7.5-8.5 weight % Cr; 0.7-1.0 weight % Mo; 0.005-0.05 weight % Al; 0.015 weight % or less P, 0.002 weight % or less S; 0.001-0.025 weight % Nb; and 0.25-0.35 weight % V, with the remainder being Fe and unavoidable impurities.

4 Claims, No Drawings

(56) References Cited

FOREIGN PATENT DOCUMENTS

| | | | | |
|---|---|---|---|---|
| JP | 8-337813 | A | | 12/1996 |
| JP | 2010-90432 | A | | 4/2010 |
| JP | 2014-95130 | A | | 5/2014 |
| JP | 2015-18868 | A | | 1/2015 |
| JP | 2017-88938 | A | | 5/2017 |
| JP | 2019-504194 | A | | 2/2019 |
| JP | 2019-505672 | A | | 2/2019 |
| JP | 2020020031 | A | * | 2/2020 |
| JP | 2020-509186 | A | | 3/2020 |
| JP | 2020-509193 | A | | 3/2020 |
| JP | 2022-553704 | A | | 12/2022 |
| KR | 10-2014-0054379 | A | | 5/2014 |
| KR | 10-2016-0078573 | A | | 7/2016 |
| KR | 10-2017-0073015 | A | | 6/2017 |
| KR | 10-2018-0015736 | A | | 2/2018 |
| KR | 10-2018-0071683 | A | | 6/2018 |
| KR | 10-2020-0036759 | A | | 4/2020 |
| KR | 10-2020-0064581 | A | | 6/2020 |
| WO | 2020/111859 | A1 | | 6/2020 |

OTHER PUBLICATIONS

Communication dated Jul. 30, 2024, issued in Japanese Application No. 2023-535675.

Extended European Search Report dated Jun. 27, 2025, issued in European application No. 21906875.6.

International Search Report for PCT/KR2021/016649 dated Mar. 4, 2022.

Communication dated Mar. 16, 2026, in Chinese Application No. 202180083753.1.

* cited by examiner

PRESSURE VESSEL STEEL PLATE HAVING EXCELLENT HIGH TEMPERATURE PWHT RESISTANCE AND METHOD FOR MANUFACTURING SAME

This Application is a National Stage of International Application No. PCT/KR2021/016649 filed Nov. 15, 2021, claiming priority based on Korean Patent Application No. 10-2020-0176051 filed Dec. 16, 2020, the entire disclosures of which are incorporated herein by reference.

TECHNICAL FIELD

The present disclosure relates to a pressure vessel steel plate having excellent high temperature PWHT resistance and a method for manufacturing the same, and more particularly, to a pressure vessel steel plate having excellent tensile strength and low temperature impact toughness even when PWHT is performed at a high temperature of 750 to 850° C. and a method for manufacturing the same.

BACKGROUND ART

When a steel plate is welded, partial thermal expansion and contraction occur, and thus, residual stress is formed inside the steel plate. Since the residual stress may be a cause of later deformation and a cause of crack growth when a base material is partially fractured, a process for removing the residual stress needs to be essentially performed in order to stabilize dimensions of a welded structure and prevent deformation.

Post weld heat treatment (PWHT) may be performed to remove the residual stress inside the steel sheet. However, the PWHT has a problem in that mechanical properties decrease due to softening and growth of grain boundaries in the steel plate, and coarsening of carbides during a heat treatment process for a long period of time. In particular, when the PWHT is 700° C. or higher, there is a problem in that the deterioration in the mechanical properties is further intensified.

As a measure for preventing the deterioration in the mechanical properties after the PWHT, Patent Document 1 discloses a medium and high temperature steel plate that contains at least one of 0.05 to 0.25 weight % of C, 0.1 to 1.0 weight % of Mn, 0.1 to 0.8 weight % of Si, 1 to 3 weight % of Cr, 0.05 to 0.3 weight % of Cu, 0.5% to 1.5 weight % of Mo, 0.05 to 0.5 weight % of Ni, 0.005 to 0.1 weight % of Al, at least of 0.005 to 0.10 weight % of Ir, and 0.005 to 0.10 weight % of Rh, a remainder of Fe and unavoidable impurities. However, there is a problem in that the medium and high temperature steel plate is difficult to apply in a state in which the PWHT is 700° C. It was difficult to find a technology suitable for this situation in other patent documents below.

Accordingly, there is a demand for a technology for manufacturing a steel plate having excellent mechanical properties even after high temperature PWHT, accompanied by thickening of steel materials and severe welding conditions.

RELATED ART DOCUMENT (Patent Document 0001) Korean Patent Laid-Open Publication No. 10-2020-0064581

(Patent Document 0002) Japanese Patent Laid-Open Publication No. 2015-018868

DISCLOSURE

Technical Problem

The present disclosure provides a pressure vessel steel plate having excellent high temperature post weld heat treatment (PWHT) resistance in which mechanical properties are not lowered even after a post weld heat treatment (PWHT) process at a high temperature, and a method for manufacturing the same.

Technical Solution

In an aspect in the present disclosure, a pressure vessel steel plate having excellent high temperature PWHT resistance includes: 0.10 to 0.16 weight % of C; 0.20 to 0.35 weight % of Si; 0.4 to 0.6 weight % of Mn; 7.5 to 8.5 weight % of Cr; 0.7 to 1.0 weight % of Mo; 0.005 to 0.05 weight % of Al; 0.015 weight % or less of P; 0.002 weight % or less of S; 0.001 to 0.025 weight % of Nb; and 0.25 to 0.35 weight % of V, with a remainder of Fe and unavoidable impurities.

A structure of the steel plate may be comprised of a mixed structure of tempered martensite and tempered bainite.

The tempered martensite may have an area fraction of 50 to 80%, and the remainder may be tempered bainite.

The steel plate may have a tensile strength of 650 MPa or more even after the PWHT at 750 to 850° C. for 10 to 50 hours.

The steel plate may have a Charpy impact energy (CVN @−30° C.) value of 100 J or more.

In another aspect in the present disclosure, a method for manufacturing a pressure vessel steel plate having excellent high temperature PWHT resistance includes: reheating, at 1070 to 1250° C., a slab containing 0.10 to 0.16 weight % of C; 0.20 to 0.35 weight % of Si; 0.4 to 0.6 weight % of Mn; 7.5 to 8.5 weight % of Cr; 0.7 to 1.0 weight % of Mo; 0.005 to 0.05 weight % of Al; 0 to 0.015 weight % of P, 0.002 weight % or less of S; 0.001 to 0.025 weight % of Nb; and 0.25 to 0.35 weight % of V, with a remainder of Fe and unavoidable impurities; hot rolling the reheated slab at a reduction ratio of 2.5 to 35% per rolling pass; performing primary heat treatment to maintain the hot-rolled steel plate at 1020 to 1070° C.; cooling the primarily heat-treated steel plate at 1 to 30° C./sec; and performing secondary heat treatment to maintain the cooled steel plate at 820 to 845° C.

A primary heat treatment time $T_1$ may be defined by the following Relational Expression 1.

$$1.3 \times t + 10 \leq T_1 \leq 1.3 \times t + 30 \quad \text{[Relational Expression 1]}$$

(In the above Relational Expression 1, $T_1$ denotes a time (min) for performing the primary heat treatment, and t denotes a thickness of the hot-rolled steel plate.)

A secondary heat treatment time $T_2$ may be defined by the following Relational Expression 2.

$$1.6 \times t + 10 \leq T_2 \leq 1.6 \times t + 30 \quad \text{[Relational Expression 2]}$$

(In the above Relational Expression 2, $T_2$ denotes a time (min) for performing the secondary heat treatment, and t denotes a thickness of the hot-rolled steel plate.)

After the secondary heat treatment process, the method may further include performing a PWHT process at 750 to 850° C. for 10 to 50 hours.

Advantageous Effects

As set forth above, according to an exemplary embodiment in the present disclosure having the above constitution, it is possible to provide a pressure vessel steel plate having excellent high temperature PWHT resistance and a method for manufacturing the same, in which mechanical properties are maintained even when the PWHT process is performed at 750 to 850° C. for a long period of time.

BEST MODE

Various advantages and features of embodiments of the present disclosure and methods accomplishing them will become apparent from the following description of embodiments with reference to the accompanying drawings. However, the present disclosure is not limited to exemplary embodiments to be described below, but may be implemented in various different forms, these exemplary embodiments will be provided only in order to make the present disclosure complete and allow those skilled in the art to completely recognize the scope of the present disclosure, and the present disclosure will be defined by the scope of the claims. Throughout the specification, like reference numerals denote like elements.

When it is determined that the detailed description of the known functions or configurations in describing the embodiments of the present disclosure may obscure the gist of the present disclosure, the detailed description thereof will be omitted. Further, the following terminologies are defined in consideration of the functions in the embodiments of the present disclosure and may be construed in different ways by users, an intention of operators, or conventions. Therefore, the definitions thereof should be construed based on the contents throughout the specification. Hereinafter, embodiments of the present disclosure will be described in detail.

In the pressure vessel steel plate containing 7.5 to 8.5 weight % of Cr, the present disclosure may provide a pressure vessel steel plate having a strong post weld heat treatment (PWHT) resistance performed at a high temperature of 700° C. or higher.

The PWHT is a heat treatment process for removing residual stress generated inside a base material during a welding or rolling process, and is performed at a high temperature for a long period of time. For this reason, the PWHT removes the residual stress in the steel plate, but causes softening and growth of grain boundaries in the base material and coarsening of carbides, so mechanical properties of the steel plate may decrease.

To prevent this, by providing the microstructure of the steel plate as the mixed structure having the tempered martensite as the main phase by properly controlling the alloy compositions and manufacturing conditions of the steel plate, it is possible to provide the pressure vessel steel plate with no decrease in mechanical properties.

The pressure vessel steel plate having excellent high temperature PWHT resistance according to the embodiment in the present disclosure includes 0.10 to 0.16 weight % of C, 0.20 to 0.35 weight % of Si, 0.4 to 0.6 weight % of Mn, 7.5 to 8.5 weight % of Cr, 0.7 to 1.0 weight % of Mo, 0.005 to 0.05 weight % of Al, 0 to 0.015 weight % of P, 0.002 weight % or less of S, and 0.001 to 0.025 weight % of Nb, with a remainder of Fe and unavoidable impurities.

Hereinafter, the composition range of the present disclosure will be described in detail. Hereinafter, unless otherwise specified, a unit is weight %.

C is added in an amount of 0.1 to 0.16 weight %.

The C is an element that improves strength, and there is a problem in that, when the content of C is less than 0.1 weight %, the strength of the matrix itself decreases, and when the content of C exceeds 0.16 weight %, the strength excessively increases and the toughness decreases. Accordingly, the C is preferably added in an amount of 0.1 to 0.16 weight %, a more preferable lower limit may be 0.12 weight %, and a more preferable upper limit may be 0.15 weight %.

Si is added in an amount of 0.2 to 0.35 weight %.

The Si is an element effective for deoxidation and solid solution strengthening, and is an element accompanied by an increase in impact transition temperature. There is a problem in that, when the Si is less than 0.2 weight %, it is difficult to expect sufficient mechanical properties due to insufficient strength of the pressure vessel steel plate, and when the Si exceeds 0.35 weight %, the weldability of the pressure vessel steel plate decreases to decrease workability and the impact toughness decreases. Accordingly, the Si is preferably added in an amount of 0.2 to 0.35 weight %, a more preferable lower limit may be 0.25 weight %, and a more preferable upper limit may be 0.32 weight %.

Mn is added in an amount of 0.4 to 0.6 weight %.

The Mn may form MnS, which is a non-metallic inclusion, together with S to be described later. The non-metallic inclusion MnS has an effect of increasing the strength of the base material by hindering the movement of dislocations inside crystal grains, but becomes a cause of decreasing elongation and low-temperature toughness at room temperature. For example, there is a problem in that, when the content of Mn exceeds 0.6 weight %, the MnS excessively formed and the elongation and low-temperature toughness significantly decreases, and when Mn is added in an amount of less than 0.4 weight %, it is difficult to secure adequate strength due to an insufficient production of MnS. For this reason, the Mn is preferably added in an amount of 0.4 to 0.6 weight %, a more preferable lower limit may be 0.5 weight %, and a more preferable upper limit may be 0.58 weight %.

Cr is added in an amount of 7.5 to 8.5 weight %.

The Cr increases hardenability to form a low-temperature transformation structure, thereby increasing yield and tensile strength, to thereby prevent a decrease in strength by slowing down a decomposition rate of cementite during tempering or PWHT after quenching. In addition, the tempered martensite structure is formed in the center of the steel plate to enhance the low-temperature strength. For this reason, it is preferable to add 7.5 weight % or more of Cr. However, when the content of Cr exceeds 8.5 weight %, coarse Cr-rich $M_{23}C_6$-type carbides may be precipitated inside the tempered martensitic structure. This greatly decreases the impact toughness of the steel plate to cause brittle fracture. In addition, when the content of Cr increases, manufacturing costs increase and weldability decreases. For this reason, the Cr is preferably added in an amount of 7.5 to 8.5 weight %, a more preferable lower limit may be 7.8 weight %, and a more preferable upper limit may be 8.3 weight %.

Mo is added in an amount of 0.7 to 1.0 weight %.

Like the Cr, the Mo may increase the high-temperature strength of the base material. In addition, it is possible to prevent cracks from occurring in the pressure vessel steel plate due to sulfides. For this reason, it is preferable that Mo is added in an amount of 0.7 weight % or more. However, since the Mo has a relatively high unit price compared to other additive elements, when the amount of Mo exceeds 1.0 weight %, production cost may excessively increase and marketability may decrease. Accordingly, the Mo is preferably added in an amount of 0.7 to 1.0 weight %, and a more preferable lower limit may be 0.8 weight %.

Al is added in an amount of 0.005 to 0.05 weight %.

The Al is one of the strong deoxidizers in the steelmaking process along with the Si. The deoxidizer takes in oxygen from the inside of the base material and induces the oxygen to be discharged in the form of CO. For this reason, when the content of Al is less than 0.005 weight %, the oxygen in the base material may increase and the quality of the steel plate may decrease. On the other hand, when the content of Al exceeds 0.05 weight %, more than necessary deoxidation effect is realized, and rather, manufacturing costs may increase and marketability may decrease. Accordingly, the Al is preferably added in an amount of 0.005 to 0.05 weight %, a more preferable lower limit may be 0.02 weight %, and a more preferable upper limit may be 0.04 weight %.

P is added in amount of 0.015 weight % or less.

The P decreases the low-temperature toughness of the pressure vessel steel plate, and is segregated at grain boundaries to become a major cause of temper brittleness. Theoretically, it is advantageous to control the content of P to be low so that the content of P is close to 0 weight %, but the P is inevitably contained in the manufacturing process, and the process for decreasing the content of P is complex and the production cost increases due to the additional process. As a result, it is desirable to set and manage the upper limit of the content of P. Therefore, it is preferable to manage the P at 0.015 weight % or less.

S is added in amount of 0.002 weight % or less.

Like the P, the S is an element that decreases the low-temperature toughness, and forms the MnS inclusions in the pressure vessel steel plate to decrease the toughness of the pressure vessel steel plate. Like the P, it is advantageous to control the content of S to be low so that the content of S is close to 0 weight %, but when considering the cost and time consumed for this, it is preferable to set and manage the upper limit of the content of S. Therefore, it is preferable to manage the S at 0.002 weight % or less.

Nb is added in an amount of 0.001 to 0.025 weight %.

The Nb is an element effective in preventing softening of a matrix forming the steel plate by forming fine carbides or nitrides in the pressure vessel steel plate. For this reason, it is preferable that the Nb is added in an amount of 0.001 weight % or more. However, when the content of Nb exceeds 0.025 weight %, the cost of the steel plate may increase and marketability may decrease. Accordingly, the Nb is preferably added in an amount of 0.001 to 0.025 weight %, a more preferable lower limit may be 0.01 weight %, and a more preferable upper limit may be 0.023 weight %.

V is added in an amount of 0.25 to 0.35 weight %.

Like the Nb, the V may easily form fine carbides and nitrides, and is an element effective in preventing the softening of the matrix. For this reason, it is preferable that the V is added in an amount of 0.25 weight % or more. However, when the content of V exceeds 0.35 weight %, the cost of the steel plate may increase and marketability may decrease. Accordingly, the V is preferably added in an amount of 0.25 to 0.35 weight %, a more preferable lower limit may be 0.28 weight %, and a more preferable upper limit may be 0.32 weight %.

Except for the above-described components, the remaining components are provided as Fe. However, since the unintended impurities from raw materials or the surrounding environment may inevitably be mixed in a normal manufacturing process, the unintended impurities may not be excluded. Since these impurities are known to those skilled in the ordinary manufacturing process, not all of them are specifically mentioned in this specification.

The composition, which is one feature of the present disclosure, has been described above. Hereinafter, the microstructure, which is another feature of the present disclosure, will be described.

In the pressure vessel steel plate having excellent high temperature PWHT resistance according to an embodiment of the present disclosure, the microstructure of the central portion of the steel plate may be comprised of the mixed structure of the tempered martensite and tempered bainite, and more preferably, the area fraction of the tempered martensite is 50% or more, and the remaining part may be comprised of the mixed structure of the tempered bainite.

The tempered martensite structure refers to a martensite structure in which residual stress is relieved in martensite through a secondary heat treatment process described later, and has the effect of supplementing brittleness while maintaining the strength of a typical martensite structure. For this reason, it is preferable that the area fraction of the tempered martensitic structure is 50% or more in order to manufacture the 650 MPa class steel plate that is the target of the present disclosure.

However, when the area fraction of the tempered martensite structure in the steel plate exceeds 80%, in the tempered martensitic structure, coarse Cr-Rich $M_{23}C_6$-type carbides are precipitated at grain boundaries, and toughness may decrease. For this reason, it is preferable that the area fraction of the tempered martensitic structure is 50 to 80%.

Meanwhile, the tempered bainite has lower strength than the tempered martensitic structure, but has relatively excellent toughness and high shock absorption energy. Through this, the tempered bainite may supplement the toughness of the pressure vessel steel plate. For this reason, the pressure vessel steel plate is preferably provided as the mixed structure of the tempered martensite structure and the tempered bainite, and more preferably, the area fraction of the tempered martensite is 50 to 80%, and the area fraction of the tempered bainite is 20% to 50%.

Even if the steel plate having the above-described composition and microstructure is additionally welded and heat-treated in a high temperature range of 750 to 850° C. for up to 50 hours, the tensile strength may be effectively maintained at 650 MPa or more.

In addition, the steel plate having the composition and microstructure as described above may have excellent low-temperature toughness even after the PWHT, and specifically, may have a Charpy impact energy value of 100 J or more at −30° C.

It can be seen that the pressure vessel steel plate manufactured according to the embodiment of the present disclosure may have excellent tensile strength and low-temperature toughness even when the PWHT is performed at high temperature.

In addition to the above pressure vessel steel plate having excellent high temperature PWHT resistance of the present disclosure, a method of manufacturing a pressure vessel steel plate having excellent high temperature PWHT resistance of the present disclosure will be described below.

According to an embodiment, the pressure vessel steel plate having excellent high temperature PWHT resistance may include: any one or more of a process of reheating the slab having the above-described composition at 1070 to 1250° C.; a process of hot rolling the reheated slab at a reduction ratio of 2.5 to 35% per rolling pass; a primary heat treatment process of maintaining the hot-rolled steel plate at 1020 to 1070° C.; a process of cooling the primarily heat-treated steel plate to 1 to 30° C.; and a secondary heat treatment process of maintaining the cooled steel plate at 820 to 845° C.

First, in the present disclosure, the process of reheating the slab having the above components may be performed. The reheating is preferably performed at 1070 to 1250° C., and when the reheating temperature is less than 1070° C., it may be difficult to secure strength because solute atoms are not dissolved as intended, and when the reheating temperature exceeds 1250° C., the mechanical properties of the steel may decrease due to overgrowth of the austenite phase in the steel. Accordingly, the reheating temperature is preferably 1070 to 1250° C., a more preferred lower limit may be 1100° C., and a more preferred upper limit may be 1170° C.

Thereafter, the steel plate may be manufactured by hot rolling the reheated slab.

According to the embodiment, the hot rolling may be performed in a recrystallization region, which is a temperature range higher than a recrystallization end temperature. In addition, the hot rolling is preferably performed at a reduction ratio of 2.5 to 35% for each rolling pass. When the reduction ratio is less than 2.5%, the tempered martensite and tempered bainite structures formed by the cooling process to be described later become coarse due to insufficient reduction, and the strength of the steel plate may decrease. On the other hand, when the reduction ratio exceeds 35%, the load on the rolling mill becomes severe and productivity may decrease. Therefore, it is preferable to control the reduction ratio for each rolling pass to be 2.5 to 35%, a more preferable lower limit may be 5%, and a more preferable upper limit may be 25%.

The hot-rolled steel plate may be subjected to a primary heat treatment process. The primary heat treatment process refers to the heat treatment for maintaining the steel plate at 1020 to 1070° C. for a time $T_1$ satisfying the following Relational Expression 1.

$$1.3 \times t + 10 \leq T_1 \leq 1.3 \times t + 30 \quad \text{[Relational Expression 1]}$$

(In the above Relational Expression 1, $T_1$ denotes a time (min) for performing the primary heat treatment, and t denotes a thickness of the hot-rolled steel plate.)

According to an embodiment, when the temperature of the primary heat treatment is less than 1020° C. or the T1 is less than $1.3Xt_1+10$ minutes, the homogenization of the structure in the steel plate may not sufficiently occur. This causes segregation in the steel plate. In addition, it is difficult to re-dissolve solute elements that are dissolved in the steel plate, which causes the mechanical properties of the steel plate to decrease.

On the other hand, when the primary heat treatment temperature exceeds 1070° C. or the $T_1$ exceeds $1.3Xt_1+30$ minutes, the crystal grains in the steel plate may grow and the strength of the steel plate may decrease.

Thereafter, the cooling process of cooling the steel plate subjected to the primary heat treatment may be performed. Specifically, in the cooling process, the steel plate subjected to the primary heat treatment may be cooled to 20 to 40° C. at a rate of 1 to 30° C./sec, and may be cooled through a water cooling treatment (DQ treatment). When the cooling rate is less than 1° C./sec, ferrite in the steel plate may not be transformed into martensite, and the area fraction of the tempered martensite structure in the steel plate may decrease. Also, the tempered martensite and tempered bainite structures may become coarse. This causes the strength of the steel plate to decrease. Also, when the cooling rate exceeds 30° C./sec, additional equipment is required to improve the cooling rate and a large amount of cooling water may be required. This may increase the manufacturing cost of the steel plate. Accordingly, the cooling rate is preferably 1 to 30° C./sec, a more preferred lower limit may be 1.5° C./sec, and a more preferred upper limit may be 25° C./sec.

The steel plate manufactured by performing the primary heat treatment and cooling process has a tensile strength of 650 MPa or more, and at the same time, it is required to secure a Charpy impact energy value of 100 J or more at −30° C. To achieve these conditions, the secondary heat treatment and PWHT process may be performed.

The secondary heat treatment process refers to a heat treatment for maintaining the steel plate at 820 to 845° C. for a time $T_2$ satisfying the following Relational Expression 2, and may be defined as a tempering heat treatment in other words.

$$1.6 \times t + 10 \leq T_2 \leq 1.6 \times t + 30 \quad \text{[Relational Expression 2]}$$

(In the above Relational Expression 2, $T_2$ denotes a time (min) for performing the secondary heat treatment, and t denotes a thickness of the hot-rolled steel plate.)

As described above, the secondary heat treatment process is preferably performed at 820 to 845° C. for 1.6Xt+10 to 1.6Xt+30 minutes. This is because when the secondary heat treatment process is performed for less than 820° C. or less than 1.6Xt+10, the dislocation recovery effect decreases, the toughness of the steel plate decreases, and it is difficult to obtain the tempered martensitic structure. On the other hand, when the secondary heat treatment process exceeds 845° C. or the heat treatment time exceeds 1.6Xt+30 minutes, the precipitate overgrows and an overaging phenomenon occurs, which may decrease the strength.

According to an embodiment, the PWHT process may be additionally performed after the secondary heat treatment process. As described above, the PWHT process is a process of heat treatment for a long period of time in a high temperature environment that removes the residual stress inside the steel plate, and specifically, refers to a process of maintaining the secondarily heat-treated steel plate at 750 to 850° C. When the PWHT process temperature is less than 750° C. or the PHWT process time is less than 10 hours, the residual stress may remain in steel plate since annealing is not sufficient. In this case, this is a cause of the deformation and the reduction of life of the steel plate. On the other hand, when the PWHT process temperature exceeds 850° C. or the PWHT process is performed exceeding 50 minutes, excessive thermal energy may be applied to the steel plate. This may promote the recrystallization of the steel plate and may reduce tensile strength to less than 650 MPa. For this reason, the PWHT process is preferably performed at 750 to 850° C. or 10 to 50 hours or less, and the lower limit of the more preferred temperature may be 780° C., and the upper limit of the more preferred temperature may be 820° C. In addition, the lower limit of more preferred time may be 20 hours.

Hereinafter, the present disclosure will be described in more detail with reference to Examples.

MODE FOR INVENTION

An alloy slab having the composition shown in Table 1 below is prepared. After reheating the alloy slab at 1120° C. for 300 minutes, the hot rolling was performed in the recrystallization region at a reduction rate of 15% per rolling pass to prepare the steel plate.

TABLE 1

| | C | Mn | Si | P | S | Al | Cr | Mo | Cu | Ni | Nb | Y |
|---|---|---|---|---|---|---|---|---|---|---|---|---|
| Inventive Steel A | 0.14 | 0.64 | 0.26 | 0.006 | 0.0010 | 0.029 | 7.85 | 0.90 | — | — | 0.016 | 0.29 |
| Inventive Steel B | 0.15 | 0.53 | 0.29 | 0.008 | 0.0014 | 0.030 | 7.95 | 0.95 | — | — | 0.015 | 0.31 |
| Inventive Steel C | 0.13 | 0.56 | 0.30 | 0.007 | 0.0013 | 0.032 | 8.15 | 0.95 | — | — | 0.021 | 0.30 |
| Comparative Steel A | 0.13 | 0.56 | 0.31 | 0.008 | 0.0011 | 0.031 | 2.29 | 0.91 | 0.14 | 0.18 | — | — |
| Comparative Steel B | 0.14 | 0.53 | 0.25 | 0.008 | 0.0011 | 0.029 | 5.21 | 0.92 | — | — | 0.018 | 0.28 |
| Comparative Steel C | 0.14 | 0.54 | 0.30 | 0.005 | 0.0010 | 0.032 | 9.54 | 0.94 | — | — | 0.020 | 0.30 |

The steel plate was cooled by air cooling until it reached 25° C. of room temperature, and then heated to 1050° C. to adjust the time according to the thickness of each steel plate, to thereby perform the primary heat treatment process. Thereafter, the steel plate was water-cooled until it reached 25° C. based on the temperature of the steel core. The thickness, primary heat treatment holding time, and cooling time of each steel plate were disclosed in Table 2 below.

Finally, the secondary heat treatment was performed on the steel plate subjected to the primary heat treatment and cooling process under the conditions of Table 2 below, and then the PWHT process was additionally performed.

TABLE 2

| | | Thickness of | Primary Heat Treatment | | Secondary Heat Treatment | | PWHT Process | |
|---|---|---|---|---|---|---|---|---|
| Division | Steel Type | Steel Plate (mm) | Temperature (° C.) | Time (min) | Temperature (° C.) | Time (min) | Temperature (° C.) | Time (min) |
| Example 1 | Inventive | 101 | 1.050 | 177 | 830 | 180 | 800 | 20 |
| Example 2 | Steel A | 150 | 1.050 | 255 | 830 | 260 | 800 | 35 |
| Example 3 | | 201 | 1.050 | 337 | 830 | 340 | 800 | 50 |
| Example 4 | Inventive | 101 | 1.050 | 177 | 830 | 180 | 800 | 20 |
| Example 5 | Steel B | 150 | 1.050 | 255 | 830 | 260 | 800 | 35 |
| Example 6 | | 201 | 1.050 | 337 | 830 | 340 | 800 | 50 |
| Example 7 | Inventive | 101 | 1.050 | 177 | 830 | 180 | 800 | 20 |
| Example 8 | Steel C | 150 | 1.050 | 255 | 830 | 260 | 800 | 35 |
| Example 9 | | 201 | 1.050 | 337 | 830 | 340 | 800 | 50 |
| Comparative Example 1 | Comparative Steel A | 101 | 1.050 | 177 | 830 | 180 | 800 | 20 |
| Comparative Example 2 | | 150 | 1.050 | 255 | 830 | 260 | 800 | 35 |
| Comparative Example 3 | | 201 | 1.050 | 337 | 830 | 340 | 800 | 50 |
| Comparative Example 4 | Comparative Steel B | 101 | 1.050 | 177 | 830 | 180 | 800 | 20 |
| Comparative Example 5 | | 150 | 1.050 | 255 | 830 | 260 | 800 | 35 |
| Comparative Example 6 | | 201 | 1.050 | 337 | 830 | 340 | 800 | 50 |
| Comparative Example 7 | Comparative Steel C | 101 | 1.050 | 177 | 830 | 180 | 800 | 20 |
| Comparative Example 8 | | 150 | 1.050 | 255 | 830 | 260 | 800 | 35 |
| Comparative Example 9 | | 201 | 1.050 | 337 | 830 | 340 | 800 | 50 |
| Comparative Example 10 | Inventive Steel A | 101 | 1.050 | 127 | 830 | 180 | 800 | 20 |
| Comparative Example 11 | | 201 | 1.050 | 257 | 830 | 340 | 800 | 50 |
| Comparative Example 12 | | 101 | 1.050 | 227 | 830 | 180 | 800 | 20 |
| Comparative Example 13 | | 201 | 1.050 | 387 | 830 | 340 | 800 | 50 |
| Comparative Example 14 | | 101 | 1.050 | 117 | 830 | 130 | 800 | 20 |
| Comparative Example 15 | | 201 | 1.050 | 117 | 830 | 290 | 800 | 50 |
| Comparative Example 16 | | 101 | 1.050 | 117 | 830 | 230 | 800 | 20 |
| Comparative Example 17 | | 201 | 1.050 | 117 | 830 | 390 | 800 | 50 |

The tempered martensite fraction (%) and mechanical properties of the steel plate prepared according to Table 2 were measured and disclosed in Table 3 below. As the mechanical properties, yield strength (YS), tensile strength (TS), elongation (EL) and low-temperature toughness (J) were measured. The low-temperature toughness was evaluated based on the Charpy impact energy (CVN @−30° C.) value obtained by performing a Charpy impact test on a specimen having a V notch at −30° C.

TABLE 3

| Division | Steel Type | Thickness of Steel Plate (mm) | Fraction of Tempered Martensite (%) | Evaluation of Mechanical Property | | | |
|---|---|---|---|---|---|---|---|
| | | | | YS (MPa) | TS (MPa) | EL (%) | CVN @ −30° C. (J) |
| Example 1 | Inventive | 101 | 65 | 535 | 665 | 30 | 232 |
| Example 2 | Steel A | 150 | 60 | 524 | 662 | 33 | 241 |
| Example 3 | | 201 | 58 | 521 | 656 | 34 | 224 |
| Example 4 | Inventive | 101 | 66 | 533 | 685 | 31 | 228 |
| Example 5 | Steel B | 150 | 62 | 529 | 669 | 32 | 239 |
| Example 6 | | 201 | 59 | 522 | 657 | 33 | 233 |
| Example 7 | Inventive | 101 | 66 | 533 | 674 | 36 | 215 |
| Example 8 | Steel C | 150 | 63 | 529 | 668 | 32 | 234 |
| Example 9 | | 201 | 60 | 528 | 659 | 31 | 228 |
| Comparative Example 1 | Comparative Steel A | 101 | 11 | 323 | 451 | 31 | 55 |
| Comparative Example 2 | | 150 | 8 | 312 | 432 | 32 | 25 |
| Comparative Example 3 | | 201 | 3 | 299 | 402 | 30 | 28 |
| Comparative Example 4 | Comparative Steel B | 101 | 24 | 416 | 561 | 33 | 62 |
| Comparative Example 5 | | 150 | 22 | 407 | 588 | 34 | 31 |
| Comparative Example 6 | | 201 | 18 | 401 | 551 | 36 | 36 |
| Comparative Example 7 | Comparative Steel C | 101 | 87 | 696 | 721 | 13 | 40 |
| Comparative Example 8 | | 150 | 82 | 682 | 717 | 15 | 45 |
| Comparative Example 9 | | 201 | 81 | 669 | 708 | 18 | 47 |
| Comparative Example 10 | Inventive Steel A | 101 | 42 | 438 | 522 | 25 | 148 |
| Comparative Example 11 | | 201 | 36 | 417 | 602 | 27 | 135 |
| Comparative Example 12 | | 101 | 48 | 405 | 537 | 32 | 189 |
| Comparative Example 13 | | 201 | 39 | 396 | 521 | 34 | 176 |
| Comparative Example 14 | | 101 | 42 | 425 | 465 | 28 | 168 |
| Comparative Example 15 | | 201 | 26 | 410 | 510 | 30 | 155 |
| Comparative Example 16 | | 101 | 41 | 419 | 557 | 31 | 178 |
| Comparative Example 17 | | 201 | 45 | 389 | 530 | 33 | 167 |

Referring to Tables 1 to 3, Examples 1 to 9, which simultaneously satisfy the alloy compositions and manufacturing conditions proposed by the present disclosure, have an area fraction of tempered martensite of 50% or more, so it may be seen that, even if the PWHT process is performed for 50 hours, the yield strength has a high strength of 650 MPa or more and more preferably 656 MPa or more. At the same time, the Charpy impact energy value at −30° C. is 100 J or more, more preferably 215 J or more, and thus, it may be confirmed that the steel plate has excellent low-temperature toughness.

Specifically, even if the PWHT process increases from 20 hours to 50 hours, the yield strength (YS) is reduced by 0.5 to 3%, and the tensile strength (TS) is reduced by about 1 to 4.5%. This is because, as described above, the tempered martensitic structure in the steel plate is formed at 50% or more based on the area fraction, which compensates for the decrease in strength due to the softening of grain boundaries and the coarsening of carbides after the PWHT.

On the other hand, in Comparative Examples 1 to 6, it may be seen that the mechanical properties significantly decrease when the PWHT process increases from 20 hours to 50 hours. Specifically, in Comparative Examples 1 to 3, which had comparative steel A containing 2.29 weight % of Cr and was heat-treated in the same manner as in Example, when the process time of the PWHT increases by 30 hours from 20 hours to 50 hours, both the yield strength (YS) and tensile strength (TS) are reduced by 7 to 10%, and the Charpy impact energy is reduced by 45 to 55%. In Comparative Examples 4 to 6 made of comparative steel B containing 5.21 weight % of Cr, the yield strength decreased by 15 to 20%, the tensile strength decreased by 10 to 15%, and the Charpy impact energy decreased by 45 to 55%.

Unlike Examples 1 to 9, the reason for the rapid decrease in mechanical properties in Comparative Examples 1 to 6 is that, when the content of Cr in the steel plate is less than 7.5 weight %, the austenite region increases and the retained austenite is generated, and thus, the fractions of the tempered martensite and the tempered bainite structure were relatively reduced.

On the other hand, when the content of Cr is 7.5 weight % or more, the austenite region decreased, so no unnecessary austenite structure remains even after the cooling process, and all the austenite structure is transformed into the martensite or bainite. As a result, it may be confirmed that, in Examples 1 to 9 containing 7.5 weight % or more of Cr, the tempered martensite was 50% or more, and in Comparative Examples 1 to 6 containing less than 7.5 weight % of Cr, the tempered martensite was less than 25%.

In addition, the retained austenite structure has a coarsened grain size and low stability, to thereby increase the brittleness of the steel plate. For this reason, it may be confirmed that Comparative Examples 1 to 6 also decrease the low-temperature toughness.

Specifically, Examples 1 to 9 maintain a tensile strength of 650 MPa or more and a low-temperature toughness of 200 J or more even after performing the PWHT process at 800° C. for 50 hours, whereas, in Comparative Examples 1 to 6, since the area fraction of the tempered martensite structure formed inside the steel plate is less than 20%, the strength of the base material is relatively low. This is because, in Examples 1 to 9, the martensitic structure having relatively excellent strength was formed in an area fraction of 50% or more, and the strength was maintained even after heat treatment, but Comparative Examples 1 to 6 has the insufficient martensitic structure, and thus, may not compensate for the decrease in strength caused by the softening of grain boundaries and the coarsening of carbides after the high-temperature PWHT.

On the other hand, it may be confirmed that Comparative Examples 7 to 9 containing 9.54 weight % of Cr had an excellent yield strength of 715 MPa on average, but had a very low elongation of 15.3% on average and a very low low-temperature toughness of 44 J on average. This is because the tempered bainite structure is formed in an excessively small amount, and thus, is difficult to compensate for the toughness of the steel plate. In addition, this is because the carbide of the coarse Cr-rich $M_{23}C_6$-type is precipitated at the tempered martensite grain boundary, and thus, the brittleness of the steel plate is greatly increased. For this reason, when considering both the strength and toughness of the steel plate, it is preferable that the tempered martensitic structure is formed in an area fraction of 50 to 80%.

Meanwhile, Comparative Examples 10 to 17 were prepared by changing the heat treatment time with inventive steel A satisfying the alloy composition proposed by the present disclosure. As a result, it may be confirmed that the mechanical properties are reduced compared to Preparation Examples 1 to 3.

Specifically, it may be confirmed that Comparative Examples 10 to 11 in which the primary heat treatment was performed for less than 50 minutes than the $T_1$ had a yield strength (YS) of 427 MPa on average and a tensile strength (TS) of 512 MPa on average, which was reduced by 15 to 25% compared to Examples 1 to 3. In addition, the Charpy impact energy was also reduced by 35 to 45% compared to Examples 1 to 3. This is because, as described above, the primary heat treatment time was insufficient and the stress inside the steel was not sufficiently removed, and thus, the unstable martensite and bainite structures were formed.

In addition, it may be confirmed that Comparative Examples 12 and 13 in which the primary heat treatment was performed exceeding 50 minutes than the $T_1$ had a yield strength (YS) of 400.5 MPa on average and a tensile strength (TS) of 529 MPa on average, which was reduced by 15 to 25% compared to Examples 1 to 3. In addition, the Charpy impact energy was 141.5 J on average, which was reduced by 15 to 25% compared to Examples 1 to 3. This proves that the strength of the steel plate decreased due to the growth of crystal grains in the steel plate.

In addition, it may be confirmed that Comparative Examples 14 and 15 in which the secondary heat treatment was performed for less than 50 minutes than the $T_2$ had a yield strength (YS) of 417.5 MPa on average and a tensile strength (TS) of 487.5 MPa on average, which was reduced by 15 to 25% compared to Examples 1 to 3. In addition, the Charpy impact energy was 161 J on average, which was reduced by 25 to 35% compared to Examples 1 to 3.

Finally, it may be confirmed that Comparative Examples 16 and 17 in which the secondary heat treatment was performed exceeding 50 minutes than the $T_2$ had a yield strength (YS) of 404 MPa on average and a tensile strength (TS) of 543.5 MPa on average, which was reduced by 20 to 30% compared to Examples 1 to 3. In addition, it may be confirmed that the Charpy impact energy was 172.5 J on average, which was reduced by 25 to 35% compared to Examples 1 to 3. Accordingly, it may be confirmed that mechanical properties such as yield strength, tensile strength, elongation, and low-temperature toughness decrease when the secondary heat treatment time is insufficient or exceeded.

In the above description, various embodiments of the present disclosure have been presented and described, but the present disclosure is not necessarily limited thereto. Those skilled in the art to which the present disclosure pertains will readily recognize that various substitutions, modifications, and changes are possible within the scope of the technical spirit of the present disclosure.

The invention claimed is:

1. A pressure vessel steel plate, comprising: 0.10 to 0.16 weight % of C; 0.20 to 0.35 weight % of Si; 0.4 to 0.6 weight % of Mn; 7.5 to 8.5 weight % of Cr; 0.7 to 1.0 weight % of Mo; 0.005 to 0.05 weight % of Al; 0.015 weight % or less of P; 0.002 weight % or less of S; 0.001 to 0.025 weight % of Nb; and 0.25 to 0.35 weight % of V, with a remainder of Fe and unavoidable impurities, wherein a structure of the steel plate consists of tempered martensite and tempered bainite.

2. The pressure vessel steel plate of claim 1, wherein the tempered martensite has an area fraction of 50 to 80%, and the remainder is tempered bainite.

3. The pressure vessel steel plate of claim 1, wherein the steel plate has a tensile strength of 650 MPa or more after a PWHT at 750 to 850° C. for 10 to 50 hours.

4. The pressure vessel steel plate of claim 3, wherein the steel plate has a Charpy impact energy (CVN @−30° C.) value of 100 J or more.

* * * * *